US006516960B1

(12) United States Patent
Schlachter et al.

(10) Patent No.: US 6,516,960 B1
(45) Date of Patent: Feb. 11, 2003

(54) METHOD FOR SYNCHRONOUSLY RETRACTING AND EXTENDING TELESCOPIC LENGTHS OF A CRANE

(75) Inventors: Jürgen Schlachter, Dellfeld (DE); Hans Allgeier, Zweibrücken (DE); Jürgen Appel, Contwig (DE)

(73) Assignee: Demag Mobile Cranes GmbH & Co. KG, Munich (DE)

( * ) Notice: Subject to any disclaimer, the term of this patent is extended or adjusted under 35 U.S.C. 154(b) by 0 days.

(21) Appl. No.: 09/980,396

(22) PCT Filed: May 25, 2000

(86) PCT No.: PCT/DE00/01741

§ 371 (c)(1),
(2), (4) Date: Nov. 16, 2001

(87) PCT Pub. No.: WO00/73197

PCT Pub. Date: Dec. 7, 2000

(30) Foreign Application Priority Data

May 26, 1999 (DE) ..... 199 25 188

(51) Int. Cl.[7] ..... B66C 23/66
(52) U.S. Cl. ..... 212/270; 212/289; 212/349
(58) Field of Search ..... 212/270, 288, 212/289, 348, 349; 340/685

(56) References Cited

U.S. PATENT DOCUMENTS 3,997,062 A * 12/1976 Hassall ..... 212/144
4,498,370 A * 2/1985 Breeden et al. ..... 91/171
4,589,076 A * 5/1986 Fujioka ..... 364/508
5,189,605 A * 2/1993 Zuehlke et al. ..... 364/140
5,257,177 A * 10/1993 Bach et al. ..... 364/167.01
5,718,345 A * 2/1998 Hade et al. ..... 212/349
5,731,987 A * 3/1998 Strong et al. ..... 364/505
6,374,147 B1 * 4/2002 Rockwood ..... 700/69
6,374,153 B1 * 4/2002 Brandt et al. ..... 700/188

FOREIGN PATENT DOCUMENTS

EP 773183 * 5/1997

* cited by examiner

*Primary Examiner*—Thomas J. Brahan
(74) *Attorney, Agent, or Firm*—Cohen, Pontani, Lieberman & Pavane

(57) ABSTRACT

A method for synchronously retracting and extending a jib of a crane having a plurality of telescoping lengths, preferably in a vehicle crane, extending and retracting being with driving means which is one of a hydraulically-driven, multistage telescoping cylinder and a plurality of single-stage telescoping cylinders operated in parallel. A pre-control transmitter transmits an electrical signal to an input of regulating electronics, which reference signal serves as a reference value for the telescoping speed of a telescoping cylinder or stage which takes on the task of guiding, and the actual value for the current position of the telescoping cylinders or stages is reported to the regulating electronics, and the latter compares the actual value of the telescoping cylinder or stage assuming the guidance task to the actual value of the telescoping cylinders or stages to be controlled and, in the event that an impermissible deviation is determined, the telescoping speed of the rest of the telescoping cylinders is increased or reduced until a synchronous telescoping of all telescoping cylinders and stages occurs.

2 Claims, 1 Drawing Sheet

METHOD FOR SYNCHRONOUSLY RETRACTING AND EXTENDING TELESCOPIC LENGTHS OF A CRANE

BACKGROUND OF THE INVENTION

The invention is directed to a method for synchronously retracting and extending a jib of a crane having a plurality of telescoping lengths, preferably in a vehicle crane, wherein jib extending and retracting is with driving means which is one of hydaulically-driven, multistage telescoping cylinder or a plurality of single stage telescoping cylinders operated in parallel.

Various telescoping systems have long been established in crane construction in the field of telescopic jibs. In one instance, a single-stage piston-cylinder unit is used as driving means for retracting and extending the individual telescoping lengths and these telescoping lengths are secured after retraction or extension by means of adjustable locking pins (EP 0 661 234). In another instance, a telescoping system is used in which the telescoping lengths which are mechanically connected with one another via cables or chains can retract and extend synchronously (DE-OS 19 06 483, DE 31 25 603 A1). The synchronous retraction and extension of the telescoping lengths is also possible by means of a multistage piston-cylinder unit which is connected at the head side with the innermost length (EP 0 460 476 A1).

SUMMARY OF THE INVENTION

It is the object of the invention to provide a method for synchronous retraction and extension of a jib of a crane having a plurality of telescoping lengths by which a defined maximum suspended load can be assigned to the respective extension length continuously during the entire telescoping process and which prevents asynchronism.

In the proposed method, for synchronously retracting and extending a jib of a crane having a plurality of telescoping lengths, wherein jib retracting and extending is with driving means which is one of a hydraulically-driven multistage telescoping cylinder, and a plurality of single-stage telescoping cylinders operated in parallel, a pilot transmitter or precontrol transmitter transmits an electrical signal to an input of a regulating electronics arrangement. This signal serves as a reference value for the telescoping speed of a telescoping cylinder or stage which takes on the task of guiding. The actual value of a present position of the telescoping cylinders or stages is reported to the regulating electronics arrangement. The regulating electronics arrangement compares the actual value of the telescoping cylinder or stage assuming the guidance task to the actual value of the rest of the telescoping cylinders or stages to be controlled, i.e., the telescoping cylinders or stages. In the event that an impermissible deviation is determined, i.e., within the framework of tolerances inherent to the system, the telescoping speed of the rest of the telescoping cylinders or stages is increased or reduced until a synchronous telescoping of all telescoping cylinders and stages occurs.

The advantage of the proposed solution consists in that asynchronism of the telescoping process is prevented in a very simple manner.

The synchronous regulation of the telescoping jib is activated by a switch; in the present example, the jib has two retractable and two extensible telescoping lengths. The telescoping cylinders are retracted and extended by the pre-control transmitter.

When retracting, a check is carried out initially to determine whether or not a synchronous position is present. If so, all telescoping cylinders are retracted synchronously while remaining within certain tolerances. A telescoping cylinder (in principle, any telescoping cylinder) is assigned the task of guiding. This is carried out at the speed corresponding to the deflection of the pre-control transmitter. The telescoping speed of the other cylinders or cylinder stages is adapted in such a way that a synchronous telescoping of all telescoping cylinders occurs while maintaining determined tolerances. If a synchronous position does not exist, the synchronous position is first produced by individual retraction of one or more cylinders. Synchronous retraction then continues in the manner described above.

The same process takes place in an analogous manner for extension. Of course, during subsequent synchronous operation, the guidance task can be assumed by a telescoping cylinder other than that for retraction.

A1=regulating electronics

Figure 1:
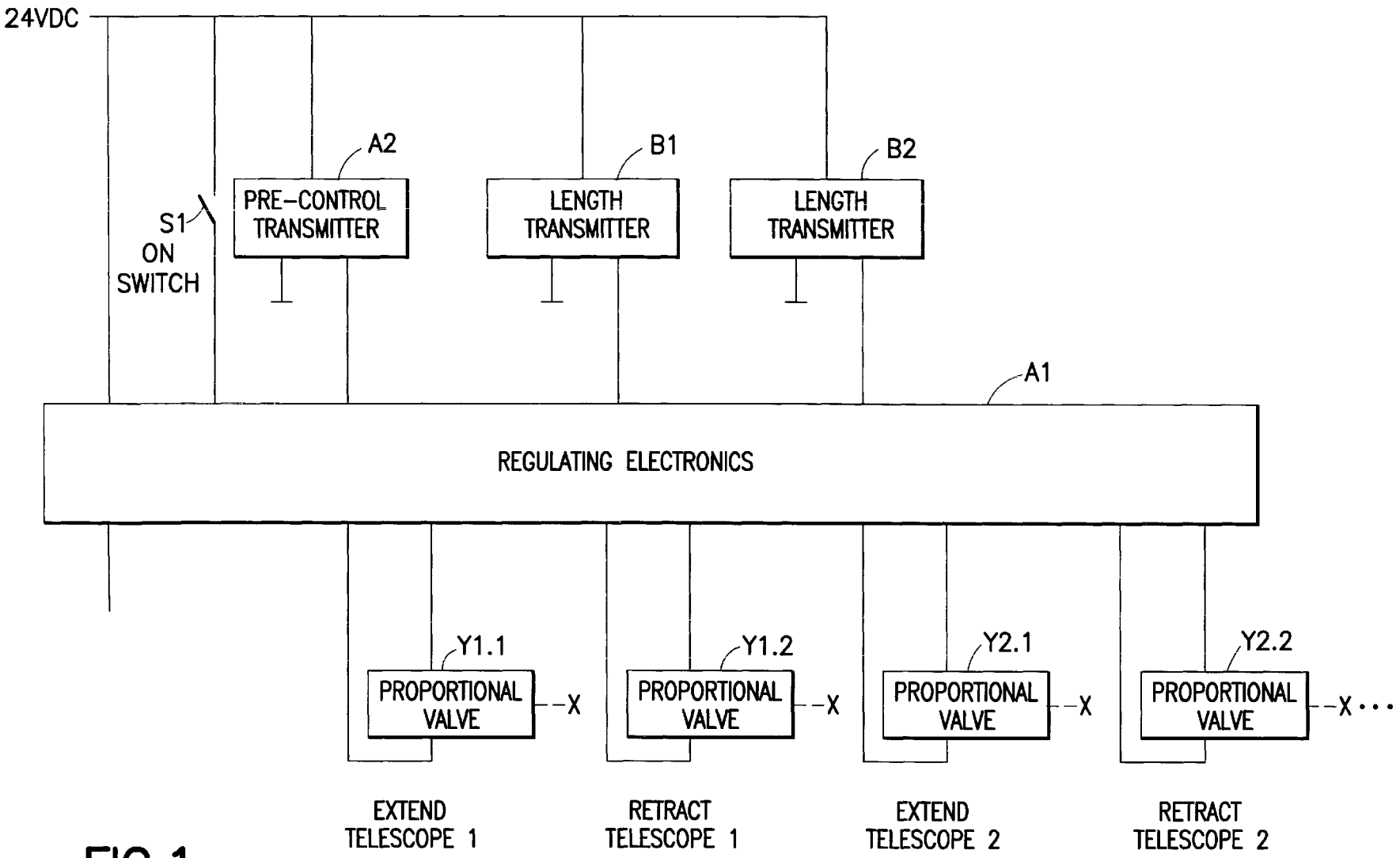
FIG. 1 is a schematic showing of the control loop with which synchronous telescoping of the telescoping length of the jib of a crane is carried out.

A2=pre-control transmitter for telescoping of the jib

B1, B2, . . . =length transmitters of the different telescoping cylinders or cylinder stages

S1=ON-switch for activating the synchronous regulation

Y1.1, Y2.1, . . . =proportional valve for extension of the telescoping cylinders

Y1.2, Y2.2, . . . =proportional valve for retraction of the telescoping cylinders

DESCRIPTION OF THE PRESENTLY PREFERRED EMBODIMENTS

After activating the synchronous regulation operation with switch $S_1$ an electrical signal (e.g., 0–10 V, 0–20 mA in potentiometric manner, . . . ) is sent to an input of the regulating electronics arrangement A1 by the pre-control transmitter A2. This signal serves as a reference value for the telescoping speed and possibly also for detecting the telescoping direction. Naturally, other signals such as engine speed or high-speed key can also influence the telescoping speed. Alternatively, the telescoping direction can also be detected by means of a direction key installed in the pre-control transmitter A2. However, this is not essential to an understanding of the basic control function, so the simple construction shown herein is taken as basis without additional reference value transmitters. Messages concerning the instantaneous extension position of the telescoping cylinders are sent back via the length transmitters B1, B2, etc. of the different telescoping cylinders or cylinder stages which send a corresponding electrical signal to the regulating electronics.

The regulating electronics now control the telescoping cylinders of the jib corresponding to the signals of the pre-control transmitters and length transmitters via the proportional valves Y1.1, Y2.1, . . . for extension of the telescoping cylinders or Y1.2, Y2.2 . . . for retracting of the telescoping cylinders wherein the movement speed is regulated via the control current of the proportional valves.

What is claimed is:

1. A method for synchronously retracting and extending a jib of a crane having a plurality of telescoping lengths, wherein jib retracting and extending is with driving means which is one of a hydraulically-driven, multistage telescoping cylinder and a plurality of single-stage telescoping cylinders operated in parallel, said method comprising:

transmitting an electrical signal from a pre-control transmitter to an input of a regulating electronics arrangement, said electrical signal comprising a telescoping speed reference value for a driving means cylinder designated as having a guidance function;

inputting telescoping cylinder and stage cylinder actual present position values to the regulating electronics arrangement;

comparing with the regulating electronics the guidance function cylinder actual value with the actual values of remaining ones of said telescoping cylinders and stage cylinders; and adjusting the telescoping speed of said remaining ones of telescoping cylinders and stage cylinders by increasing and decreasing said telescoping speed in correspondence with impermissible deviations of said telescoping speed thereof until synchronous telescoping of all said telescoping cylinders and stage cylinders is established.

2. The method according to claim 1, wherein upon a determination of a nonsynchronous position of the telescoping cylinders and stage cylinders during an extension under load, further extension is halted and cylinder retraction initiated until cylinder synchronous positioning is reestablished.

* * * * *